United States Patent [19]

Pogharian et al.

[11] Patent Number: 4,466,162

[45] Date of Patent: Aug. 21, 1984

[54] JEWELRY CLASP

[76] Inventors: Mardig V. Pogharian; Vahan M. Pogharian, both of 8513 Fullbright Ave., Canoga Park, Calif. 91306

[21] Appl. No.: 316,329

[22] Filed: Oct. 29, 1981

[51] Int. Cl.[3] ..... A44B 17/00

[52] U.S. Cl. ..... 24/585; 24/664

[58] Field of Search ..... 24/211 L, 206 R, 211 M, 24/255 SL, 219, 220, 217 R, 234, 235; 63/7, 11, 15.45, 15.5, 15.65; 59/93

[56] References Cited

U.S. PATENT DOCUMENTS

| | | | |
|---|---|---|---|
| 1,182,198 | 5/1916 | Noden | 24/206 R |
| 1,344,816 | 6/1920 | Passage | 24/206 R |
| 1,623,891 | 4/1927 | Shearer | 24/206 R |
| 1,823,043 | 9/1931 | Heugas | 24/206 R |
| 3,267,545 | 8/1966 | Eckart | 24/206 R |

FOREIGN PATENT DOCUMENTS

| | | | |
|---|---|---|---|
| 35972 | 12/1929 | France | 24/206 R |

*Primary Examiner*—F. Barry Shay

*Attorney, Agent, or Firm*—John Joseph Hall

[57] ABSTRACT

A jewelry clasp comprising a female member with a pull-up lever integrally formed on the surface of its top and a stop member integrally formed underneath its top, for receiving a male member having a planar shape and an opening therein for engagement with the stop member for locking the jewelry clasp.

4 Claims, 7 Drawing Figures

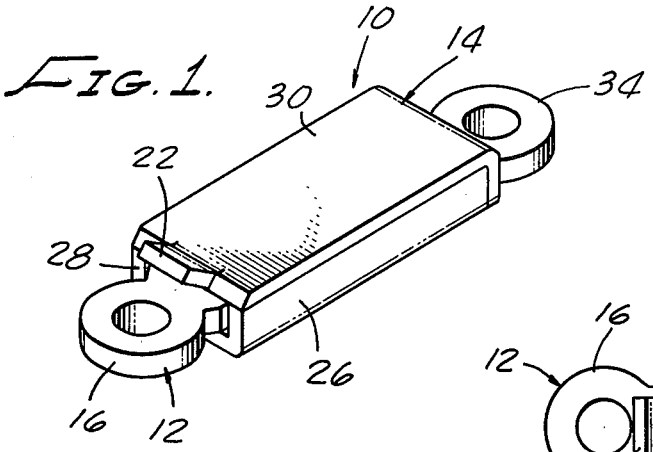
FIG. 1.
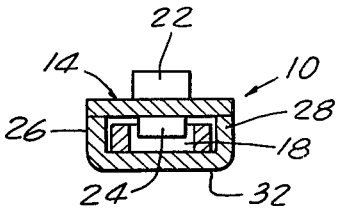
FIG. 4.
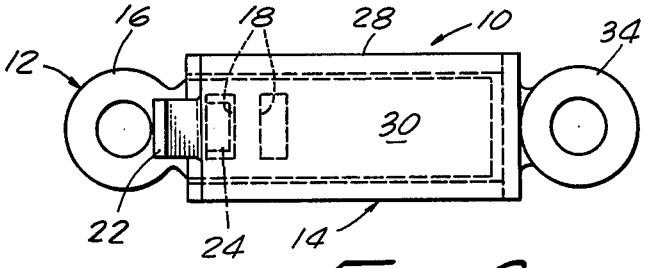
FIG. 2.
FIG. 3.
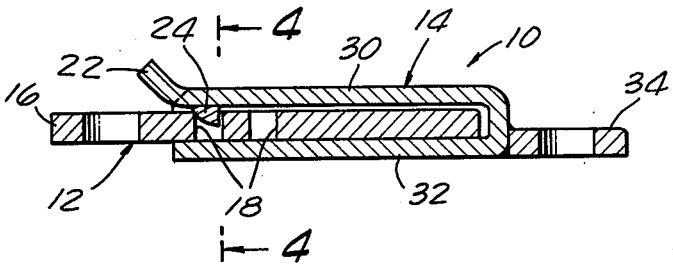
FIG. 5.
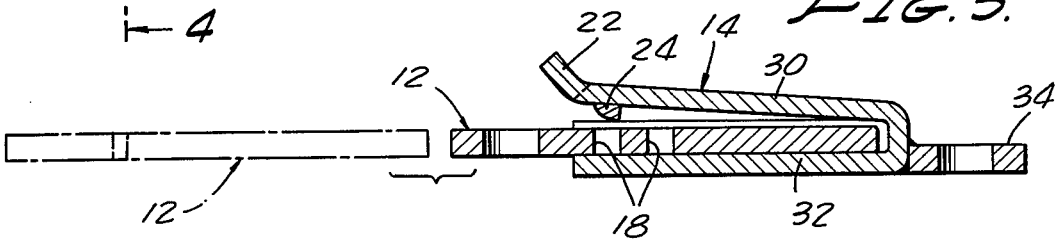
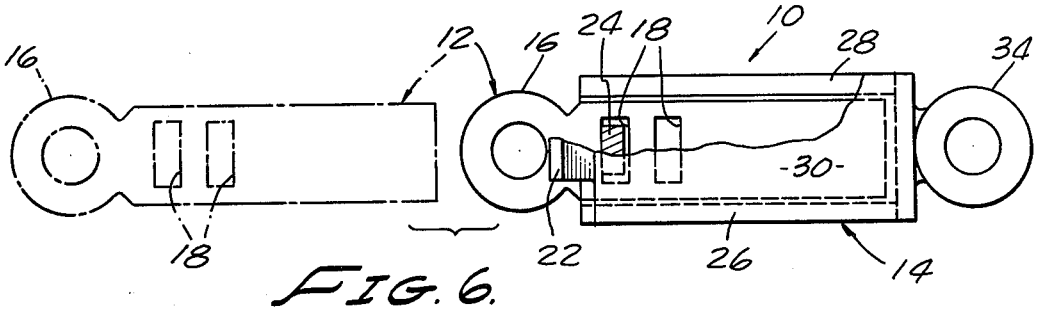
FIG. 6.
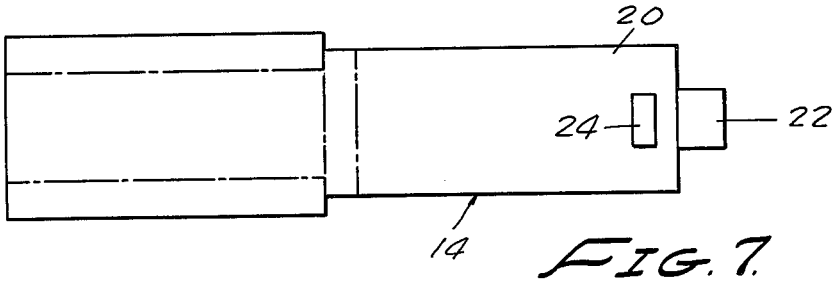
FIG. 7.

JEWELRY CLASP

SUMMARY OF THE INVENTION

Although jewelry clasps having male and female members are known in the prior art, such jewelry clasps are made up of many component parts and are difficult to use in manufacture.

The present invention provides an improved jewelry clasp dispensing with the need of spring means and a plurality of component parts, using only two parts, a male member and a female member.

The male member is formed into a tongue like shape with a planar top and bottom and at least one opening in its center portion near its outer end, which end is provided with a ring member.

The female member is formed preferably from a single piece of material, with an integral pull-up lever and an integral stop member, positioned so that the pull-up lever is located on the surface of the top of the female member, and the stop member is located underneath the surface of the top.

The female member is formed by bending the single piece of material to produce a rectangular, box-like compartment with parallell sides, a bottom, and a top. The top of the female member is not joined to the tops of the side walls but rest thereon in closed proximity. Any material may be used for the female member as well as the male member which has the requisite strength and resilience to adequately produce the locking and unlocking function of the jewelry clasp.

The invention provides a secure clasp for various kinds of jewelry, and yet has only two parts which can be easily manufactured and are not easily damaged, and dispense with a spring as well as other component parts of conventional clasps.

It is, therefore, an object of this invention to provide a liable and convenient jewelry clasp of the male member and female member type.

Another object of this invention is to provide a jewelry clasp which is relatively easy to manufacture and to use.

A further object of this invention is to provide a jewelry clasp which dispenses with the need of a spring and other component parts in conventional jewelry clasps.

These and other objects will be more readily understood by reference to the accompanying drawing of a preferred embodiment, in which:

FIG. 1 is a perspective view of the invention in a locked position.

FIG. 2 is a top plan view of the invention and partial section.

FIG. 3 is a side elevational sectional view of the invention in locked position.

FIG. 4 is a view taken along line 4—4 of FIG. 3.

FIG. 5 is a side elevational view showing the removal of the male member.

FIG. 6 is a top view and partial section showing the configuration of the male member and its position in the locked condition of the invention.

FIG. 7 is a plan view of the single piece of material used to form the female member before bending to shape the female member.

The jewelry clasp 10 has a male member 12 and a female member 14. The male member is oblongue or tongue-like in shape, with a planar top and bottom. The male member 12 has a ring 16 at its outer end and is provided with at least one, and preferably two or more, openings 18 in its center portion and located near its outer end. The openings may be of any shape, but are preferably oblongue.

The female member 14 is formed preferably from a single piece 20 of suitable material having resilience or springingness, such as a suitable gold alloy or stainless steel, and the like, cut to the proper size, and provided at one end with an integrally formed pull-up lever 22. A stop member 24 is integrally formed on the inside surface of the piece 20, or alternatively, mounted thereon. The piece 20 is then folded to shape the female member 14 into a rectangular, box-like form, with paallel sides 26 and 28, a top 30, and a bottom 32, with a pull-up lever 22 on top of top 30, at the outer end of female member 14, and with the stop member 24 located under the top 30 enclosed to the outer end of female member 14. The top 30 is not connected to the top side walls 26 and 28, but rest thereon in close proximity thereto. A ring 34 is mounted by any suitable means to the inner end of female member 14.

In operation, the male member 12 is inserted into the female member 14 until the stop member 24 engages an opening 18, which places the jewelry clasp in a locked position. Additional openings 18 may be provided for additional security against accidental release of male member 12.

When it is desired to unlock jewelry clasp 10, pull-up lever 22 is pulled-up, forcing the resilient top 30 of the female member 14 to move up just enough to disengage stop member 24 from opening 18, thereby releasing male member 12 which may then be pulled out from female member 14, unlocking the jewelry clasp 10.

Although we have described a prefer embodiment of our invention, it is understood that numerous changes in construction and arrangement of the parts may be made within the spirit and scope of the invention as hereinafter claimed.

We claim:

1. A Jewelry clasp comprising:

a longitudinal male member having an oblong planar form with an opening therein spaced from its outer end; and a longitudinal planar female member receiving said male member, said female member having a longitudinal bottom wall, integrally formed parallel sides extending upwardly from the longitudinal edges of said bottom wall, and an integrally formed top including a longitudinal planar portion resting on the tops of said parallel sides and a short vertical portion connecting the inner end of said planar portion with the inner end of said bottom wall, said integrally formed bottom wall, parallel sides and top forming a chamber for receiving said male member that is open only at its outer end, the outer end of said planar portion of said top having an integrally formed pull-up lever thereon inclined upwardly from its surface, and an integrally formed stop member underneath for engaging said opening in the male member when it is inserted in the chamber in the female member, thereby locking the jewelry clasp with said male member closing said opening at said outer end of said chamber, the clasp being unlocked by engaging said pull-up lever and lifting the outer end of said top, said top being resilient acting and normally resting on said parallel sides.

2. A jewelry clasp according to claim 1 in which the male member has a plurality of openings.

3. A jewelry clasp according to claim 1 in which the opening in said male member is oblong in shape.

4. A jewelry clasp according to claim 1 in which said male member has a plurality of oblong openings.

* * * * *